US009297102B2

(12) United States Patent
Yokoyama et al.

(10) Patent No.: US 9,297,102 B2
(45) Date of Patent: Mar. 29, 2016

(54) PRESSER DEVICE WITH FABRIC GUIDE

(71) Applicant: JANOME SEWING MACHINE CO., LTD., Hachioji-shi, Tokyo (JP)

(72) Inventors: Ushio Yokoyama, Hachioji (JP); Muneyuki Ishikawa, Hachioji (JP); Chiyo Toyomi, Hachioji (JP)

(73) Assignee: JANOME SEWING MACHINE COMPANY LIMITED, Tokyo (JP)

( * ) Notice: Subject to any disclaimer, the term of this patent is extended or adjusted under 35 U.S.C. 154(b) by 0 days.

(21) Appl. No.: 14/528,604

(22) Filed: Oct. 30, 2014

(65) Prior Publication Data

US 2015/0167217 A1 Jun. 18, 2015

(30) Foreign Application Priority Data

Dec. 18, 2013 (JP) ..... 2013-260835

(51) Int. Cl.

| | |
|---|---|
| ***D05B 29/06*** | (2006.01) |
| ***D05B 29/12*** | (2006.01) |
| ***D05B 35/10*** | (2006.01) |
| *A41H 1/00* | (2006.01) |

(52) U.S. Cl.

CPC ..... *D05B 29/06* (2013.01); *D05B 29/12* (2013.01); *D05B 35/10* (2013.01); *A41H 1/00* (2013.01)

(58) Field of Classification Search

CPC ..... D05B 29/00; D05B 29/04; D05B 29/06; D05B 29/08; D05B 29/12; D05B 35/10; A41H 1/00; B65H 7/00

USPC ..... 112/151, 153, 235

See application file for complete search history.

(56) References Cited

U.S. PATENT DOCUMENTS

| | | | | | |
|---|---|---|---|---|---|
| 822,340 | A * | 6/1906 | Bivins | 112/235 |
| 1,053,548 | A * | 2/1913 | Tela | 112/151 |
| 1,852,952 | A * | 4/1932 | Chudner | 112/151 |
| 2,130,446 | A * | 9/1938 | Rakov | 112/151 |
| 2,147,128 | A * | 2/1939 | Sailer | 112/235 |
| 2,478,032 | A * | 8/1949 | Wallsh | 112/151 |
| 3,020,864 | A * | 2/1962 | Katz | 112/153 |
| 4,899,677 | A | 2/1990 | Frey et al. | |
| 6,244,202 | B1 * | 6/2001 | Tsuta | 112/260 |
| 7,360,496 | B2 * | 4/2008 | Niizeki | 112/153 |

FOREIGN PATENT DOCUMENTS

| | | |
|---|---|---|
| JP | 52-710 | 1/1977 |
| JP | 56-45578 Y2 | 10/1981 |
| JP | 10-295968 A | 11/1998 |

* cited by examiner

*Primary Examiner* — Ismael Izaguirre

(74) *Attorney, Agent, or Firm* — Westerman, Hattori, Daniels & Adrian, LLP

(57) ABSTRACT

A presser device with a fabric guide including a presser foot mounted on a presser bar of a sewing machine; a fabric guide body provided parallel to the presser foot, a position of the fabric guide body being slidable and adjustable; a guide pin provided from a lateral portion of the presser foot in a direction orthogonal to a fabric feeding direction; the fabric guide body guiding an edge of a fabric, the guide pin being inserted through a guide hole of the fabric guide body; a guide pin pressing plate pivotally fitted to the fabric guide body. The guide pin pressing plate having a pushing-up portion that abuts against a needle plate and that exerts a pivoting force about a pivoting point, and a pressing hole through which the guide pin is inserted, the pressing hole applying pressing force to the guide pin.

28 Claims, 6 Drawing Sheets

PRESSER DEVICE WITH FABRIC GUIDE

BACKGROUND OF THE INVENTION

1. Field of the Invention

The present disclosure relates to a presser device with a fabric guide that is mounted on a presser bar of a household sewing machine and that is used when carrying out edge stitching and, more particularly, relates to a presser device with a fabric guide that can slide and adjust a fabric guide body according to a distance (a seam allowance) from an edge of a fabric to a needle location.

2. Description of the Related Art

When carrying out edge stitching with a household sewing machine, stitching in a straight line needs to be carried out while keeping a constant distance from an edge of a fabric or from a stepped part where the fabric is folded back.

Accordingly, the following assistive tools for facilitating edge stitching have hitherto been known.

a. A blind-stitching presser tool for a sewing machine disclosed in Japanese Examined Utility Model Registration Application Publication No. 56-45578 that can adjust a width of a seam allowance by rotating an adjustment screw provided in a presser tool to transversely move a gauge bar formed with a guide on its tip.

b. A stitch ruler disclosed in Japanese Unexamined Patent Application Publication No. 10-295968 that transversely moves a guide ruler along a guide bar attached to a fabric presser holder and that fixes the guide ruler to the guide bar with a screw.

c. A presser metal of a sewing machine disclosed in Japanese Examined Utility Model Registration Application Publication No. 52-710 in which a through hole that elastically deforms when a load is applied to the fabric presser portion is formed and in which a fabric guide ruler is mounted in the through hole so as to be slidable when no load is applied to the fabric presser portion.

d. A presser with an edge guide disclosed in Japanese Unexamined Utility Model Registration Application Publication No. 1-62780 (U.S. Pat. No. 4,899,677) in which the edge guide is slidably provided in a groove in a presser bottom portion and in which the edge guide can be fixed at a desired position by engaging a tip of a lock unit with a groove provided on an upper surface of the edge guide.

However, since the blind-stitching presser tool described in the above Japanese Examined Utility Model Registration Application Publication No. 56-45578 adopts a mechanism that transversely moves the gauge with the adjustment screw, rattling in the transverse direction tends to occur and, further, when performing a considerably large degree of adjustment, the adjustment screw needs to be turned a number of times such that adjusting is disadvantageously arduous.

Furthermore in the stitch ruler described in the above Japanese Unexamined Patent Application Publication No. 10-295968, the screw needs to be retightened each time the position of the guide ruler is changed; accordingly, positioning of the guide ruler is bothersome.

Furthermore, while the stitch ruler described above is versatile and can be attached to a variety of fabric presser tools, the stitch ruler needs to be attached separate to the fabric presser tool and, disadvantageously, the stitch ruler may be lost when not used.

Furthermore, while the presser metal described in Japanese Examined Utility Model Registration Application Publication No. 52-710 can secure the fabric guide ruler to the fabric presser tool by mere application of a load to the fabric presser tool without the need for a presser screw and the like, when no load is applied to the fabric presser tool, disadvantageously, the fabric guide ruler unexpectedly moves with respect to the fabric presser tool.

Furthermore, since the presser including the edge guide described in Japanese Unexamined Utility Model Registration Application Publication No. 1-62780 (U.S. Pat. No. 4,899,677) carries out positioning of the slidable edge guide by engaging a lock unit with one of the grooves provided with a predetermined pitch between one another, disadvantageously, the lock unit cannot be set between the pitches and the edge guide cannot be set at a subtle position.

Furthermore, since fixing carried out with the lock unit is not strong, when the edge guide is unintentionally touched, the fixed position of the edge guide may be moved and the seam allowance may be changed, disadvantageously resulting in difficulty in repeating stitching with the same seam allowance.

The present disclosure challenges to overcome the above problems and an object thereof is to provide a presser device with a fabric guide that is capable of performing edge stitching having a desired seam allowance while maintaining the position of the fabric guide body by mere sliding and adjusting, as required, of the fabric guide body that is integrally formed with the presser foot.

SUMMARY OF THE INVENTION

In order to solve the above-described problems, as a pressing device with a fabric guide, the present disclosure adopts a configuration that includes a presser foot that is mounted on a presser bar of a sewing machine; a fabric guide body that is provided parallel to the presser foot, a position of the fabric guide body being slidable and adjustable; a guide pin that is provided from a lateral portion of the presser foot in a direction orthogonal to a fabric feeding direction; the fabric guide body guiding an edge of a fabric, the guide pin being inserted through a guide hole of the fabric guide body; a guide pin pressing plate that is pivotally fitted to the fabric guide body. The guide pin pressing plate having a pushing-up portion that abuts against a needle plate and that exerts a pivoting force about a pivoting point, and a pressing hole through which the guide pin is inserted, the pressing hole applying pressing force to the guide pin.

As an embodiment of the present disclosure, a configuration is adopted in which the pushing-up portion of the guide pin pressing plate further serves as a guide portion that guides the edge of a fabric and in which the pressing hole of the guide pin pressing plate includes a flat portion formed on a side that applies pressing force to the guide pin.

Furthermore, as a specific embodiment of the guide pin pressing plate, a configuration is adopted in which the guide pin pressing plate is formed of a plate-shaped flexible material that extends along an upper surface of the fabric guide body and includes the pushing-up portion that protrudes below a bottom surface of the presser foot, a top surface portion that covers an upper surface of the fabric guide body, and a pair of holding portions that hold rear lateral sides of the fabric guide body therebetween and that are each provided with the pressing hole at a rear end of the fabric guide body.

As another embodiment of the present disclosure, a configuration is adopted that further includes a lever that is pivotally fitted to the fabric guide body, the lever fixing and releasing the fabric guide body to and from the guide pin by being swung to a position in which a tip of a hook holds the guide pin and to a position in which the tip of the hook is released from the guide pin.

Furthermore, as another embodiment of the present disclosure, a configuration is adopted in which the presser foot includes a gauge that is provided parallel to the guide pin from the front lateral side of the presser foot, the gauge being provided with a scale, and in which the fabric guide body includes an insertion hole into which the gauge is inserted.

The presser device with a fabric guide according to the present disclosure includes a guide pin that is provided from a lateral portion of the presser foot in a direction orthogonal to a fabric feeding direction; a fabric guide body guiding an edge of a fabric, the guide pin being inserted through a guide hole of the fabric guide body; a guide pin pressing plate that is pivotally fitted to the fabric guide body, in which the guide pin pressing plate having a pushing-up portion that abuts against a needle plate and that exerts a pivoting force about a pivoting point, and a pressing hole through which the guide pin is inserted, the pressing hole applying pressing force to the guide pin. At the time of sewing, the pushing-up portion interlocking with the lowering movement of the presser foot abuts against the needle plate and the guide pin pressing plate pivots about a pivoting point such that the pressing hole applies pressing force to the guide pin; accordingly, without any other fixing elements, the position of the fabric guide body can be firmly maintained with respect to the guide pin and the fabric guide body can be firmly fixed to the guide pin.

Furthermore, the pushing-up portion interlocking with the rising movement of the presser foot after stitching has been completed is separated from the needle plate, and the pressing hole of the guide pin pressing plate releases the pressure applied to the guide pin; as a result, the sliding and adjusting of the fabric guide body is facilitated.

Furthermore, in the presser device with a fabric guide according to the present disclosure, since the pushing-up portion of the guide pin pressing plate further serves as a guide portion that guides an edge of a fabric, the guide plate and the guide pin pressing plate can be formed integrally and, further, the pressing hole can be pressed against the guide pin in a more effective manner.

Furthermore, in the presser device with a fabric guide according to the present disclosure, since the pressing hole of the guide pin pressing plate is formed with a flat portion on the side that applies pressing force to the guide pin, even if the position where the pressing hole abuts against the outer periphery of the guide pin becomes out of position, because the pressing hole and the guide pin are in point contact with each other, a certain force can be applied to the guide pin.

Furthermore, in the presser device with a fabric guide according to the present disclosure, a lever is pivotally fitted to the fabric guide body and is swung to a position in which a tip of a hook holds the guide pin and to a position in which the tip of the hook is released from the guide pin; accordingly, the fabric guide body can be fixed and released to and from the guide pin in a further reliable manner.

Furthermore, in the presser device with a fabric guide according to the present disclosure, since a gauge is provided parallel to the guide pin from the front lateral side of the presser foot, the gauge being provided with a scale, visibility of the scale can be increased, and, further, since the gauge is inserted into the insertion hole formed in the fabric guide body, the fabric guide body can be supported with respect to the presser foot in a stable manner at two locations of the guide pin and the gauge.

BRIEF DESCRIPTION OF THE DRAWINGS

FIGS. 2A and 2B are diagrams illustrating the entire presser device with a fabric guide according to the first embodiment, in which FIG. 2A is a top view and FIG. 2B is a right side view.

FIGS. 5A to 5C are diagrams illustrating states of a lever according to an embodiment of the present disclosure fixing and releasing a fabric guide body to and from a guide pin, in which FIG. 5A is a partial perspective view illustrating a released state, FIG. 5B is a partial cross-sectional view illustrating the released state, and FIG. 5C is a partial cross-sectional view illustrating a fixed state.

FIGS. 7A to 7B are diagrams illustrating the entire presser device with a fabric guide according to a third embodiment of the present disclosure, in which FIG. 7A is a perspective view and FIG. 7B is a right side view illustrating a state in which the guide pin is removed from the stopper ring after placing the presser device on the needle plate.

DESCRIPTION OF THE PREFERRED EMBODIMENTS

Presser devices with a fabric guide according to the embodiments of the present disclosure will be described next with reference to the drawings illustrating the embodiments.

First Embodiment

Figure 1:
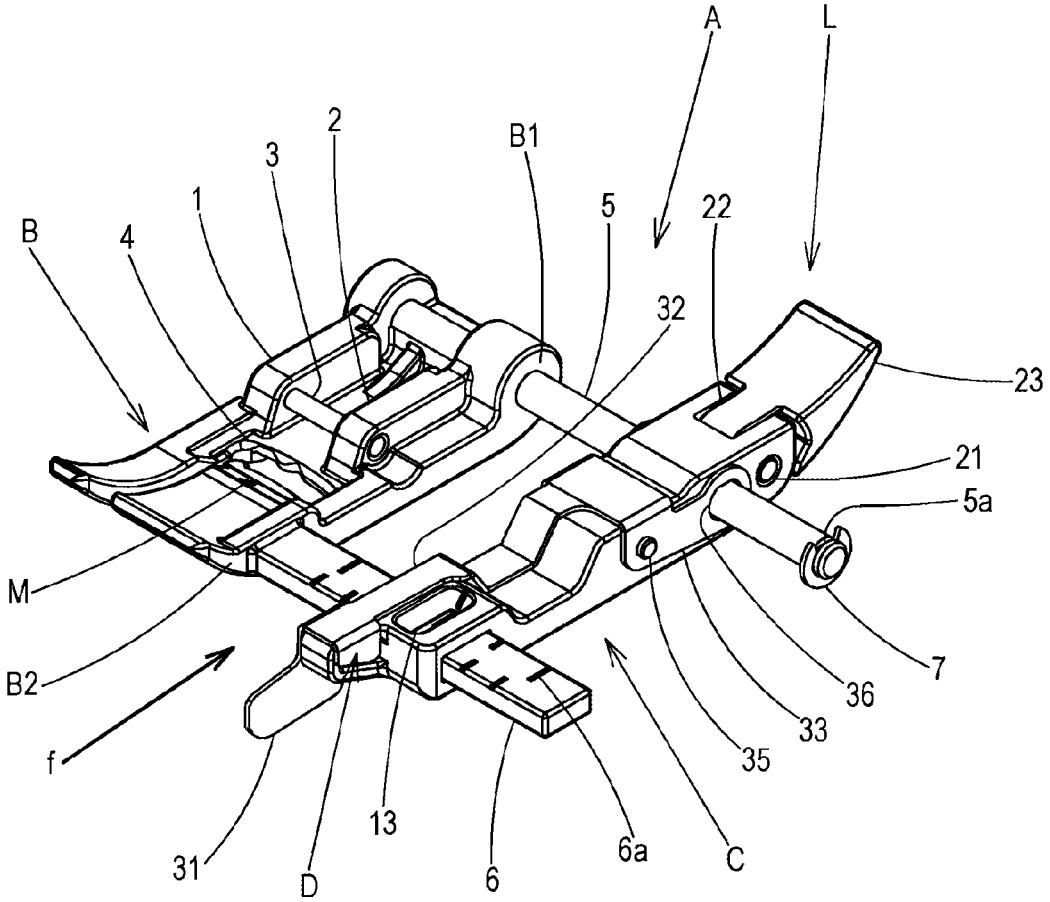
FIG. 1 is a perspective view illustrating the entire presser device with a fabric guide according to a first embodiment of the present disclosure.
Figure 2A:
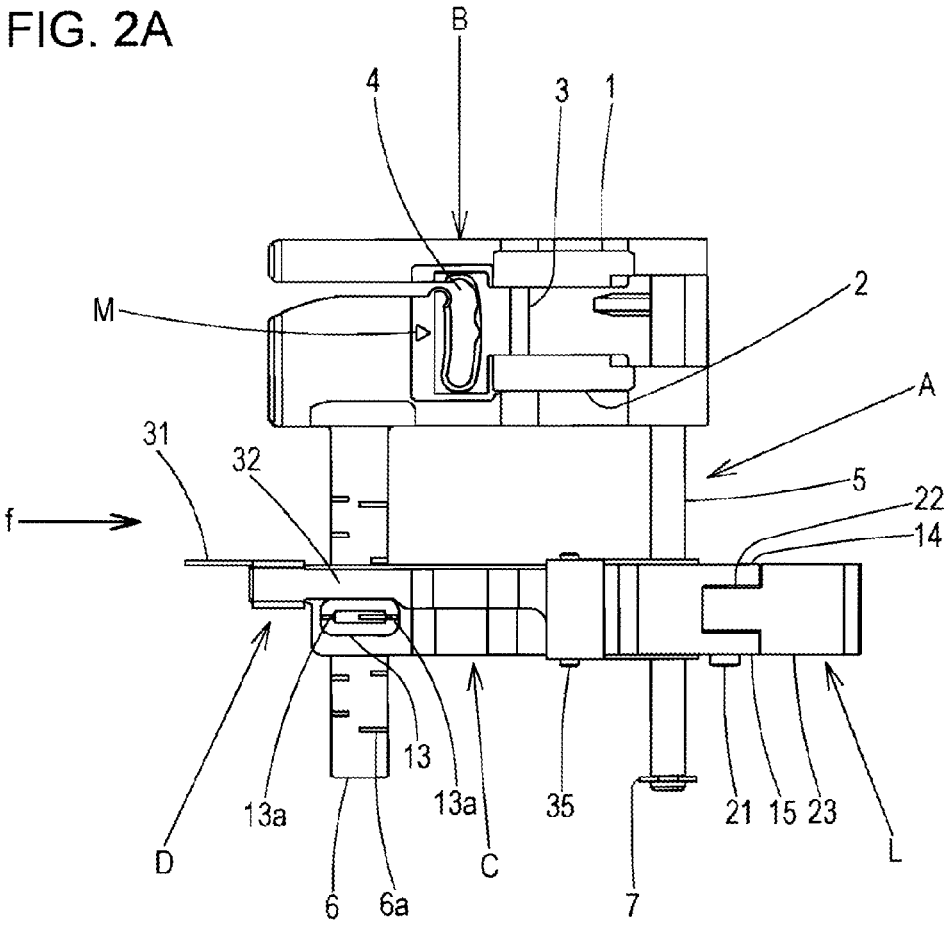
Figure 2B:
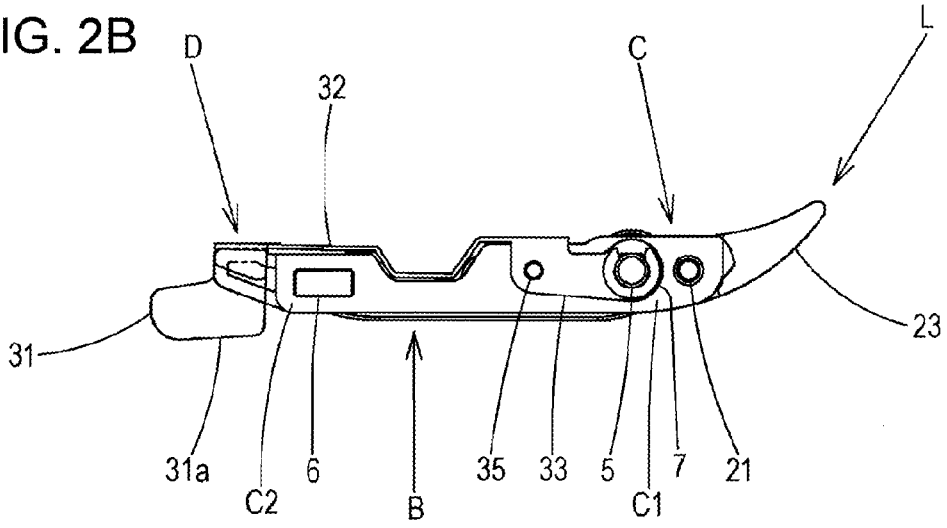
Figure 3:
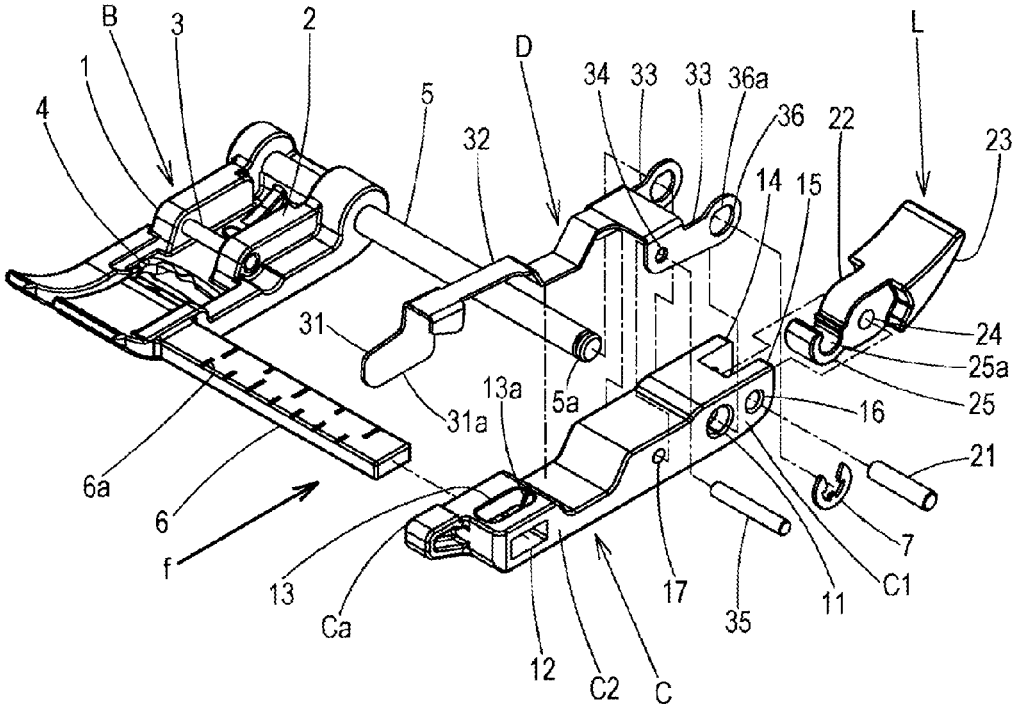
FIG. 3 is a perspective view illustrating the presser device with a fabric guide according to the first embodiment that has been exploded into individual members.

Referring to FIGS. 1 to 3, reference character A represents a presser device with a fabric guide, the presser device A being mounted at a lower end of a presser bar of a sewing machine so as to maintain a piece of fabric thereunder. The presser device A with a fabric guide includes a presser foot B, a fabric guide body C that is provided parallel to the presser foot B, the position of the fabric guide body C being slidably adjustable, and a guide pin pressing plate D that is pivotally fitted to the fabric guide body C.

Note that in the following description, the left-hand side of FIG. 2A that is a top view is referred to as a "front", the right-hand side thereof is referred to as a "rear", the upper side thereof is referred to as a "left", the lower side thereof is referred to as a "right", and the up-down direction thereof is referred to as a "transverse direction".

The presser foot B is formed of transparent synthetic resin and has a plate shape having a warped tip. A pair of opposing support pieces 1 and 2 are formed integrally with an upper surface of the presser foot B and, further, a rod pin 3 is inserted across the pair of opposing support pieces 1 and 2.

A transversely elongated opening 4 through which a needle (not shown) of a zigzag sewing machine can be inserted is formed in the presser foot B, and, as illustrated in FIG. 2A, a needle position mark M serving as a mark indicating the needle location for straight stitching is provided at the middle and on the front side of the opening 4.

Furthermore, a cylindrical metal guide pin 5 extending from the rear lateral side portion B1 in the transverse direction (a direction orthogonal to a fabric feeding direction f) is provided in the presser foot B, and a rectangular parallelepiped-shaped gauge 6 that is integrally formed with the presser foot B and that extends from the front lateral side portion B2 in a parallel manner to the guide pin 5 is provided.

Scales 6*a* that indicate the distance from the needle position mark M to a left lateral side of a guide portion 31 described later are provided in two units, specifically, in millimeters and in inches, on an upper surface of the gauge 6 in a parallel manner.

As illustrated in FIG. 3, the fabric guide body C is formed of synthetic resin such that a dimension of the fabric guide body C in the front-rear direction is similar to that of the presser foot B and a dimension of the fabric guide body C in the transverse direction is smaller than that of the presser foot B, and such that a tip portion Ca has an elongated block-shape that is inclined like a sled.

Furthermore, the guide pin 5 is passed through and is fitted into the fabric guide body C through a circular guide hole 11 formed in a rear lateral side portion C1, and the gauge 6 is passed through and is fitted into the fabric guide body C through a square gauge insertion hole 12 formed in a front lateral side portion C2.

As a result, the fabric guide body C is supported in a stable manner by the guide pin 5 and the gauge 6 that are provided in the transverse direction from the rear lateral side portion B1 and the front lateral side portion B2, respectively, of the presser foot B and is allowed to slide only in the transverse direction.

Since a stopper ring 7 is fitted onto a groove 5*a* formed on an outer peripheral surface of the tip portion of the guide pin 5, the fabric guide body C can be slid until the fabric guide body C abuts against the stopper ring 7 at the tip portion of the guide pin 5.

Furthermore, a window 13 for sighting the scales 6*a* of the gauge 6 is formed on a front upper side of the fabric guide body C so as to reach the gauge insertion hole 12.

Moreover, as illustrated in FIG. 2A, marks 13*a* are provided at an edge of the window 13 in the front-rear direction for carrying out positioning between the fabric guide body C and the scales 6*a* of the gauge 6.

Note that as described later, in order to support a pivot pin 21 that pivotally supports a lever L in a swingable manner, a pair of protruding portions 14 and 15 are formed at a rear end portion of the fabric guide body C and support holes 16 are formed through the lateral sides of the protruding portions 14 and 15.

Furthermore, a pin hole 17 into which a spring pin 35 described later is inserted is formed in the middle of a lateral side of the fabric guide body C.

The guide pin pressing plate D is formed of a plate-shaped flexible material, for example, a spring steel, that extends along an upper surface of the fabric guide body C and that is bent perpendicularly so as to hold the two sides of the tip portion Ca of the fabric guide body C from above. The guide pin pressing plate D includes a guide portion 31 that is a perpendicularly bent portion on the left side of the perpendicularly bent portions when viewed from the front and that protrudes out to a front of the fabric guide body C, a top surface portion 32 that covers a portion between an upper surface of the tip portion of the fabric guide body C and an upper surface above the pin hole 17, and a pair of holding portions 33 that hold the rear lateral side portion C1 of the fabric guide body C therebetween.

Furthermore, fulcrum holes 34 are formed at the front of the holding portions 33. By inserting the spring pin 35 into the fulcrum holes 34 through the pin hole 17 in the lateral side of the fabric guide body C, the guide pin pressing plate D is pivotally fitted along the lateral sides of the fabric guide body C.

Pressing holes 36 into which the guide pin 5 is inserted and that each have a diameter that is slightly larger than that of the guide pin 5 are provided at rear ends of the holding portions 33.

Flat portions 36*a* are formed at upper portions of the pressing holes 36, in which the upper portions correspond to the sides that apply pressing force to the guide pin 5.

Note that in the present embodiment, the guide portion 31 further serves as a pushing-up portion described later in another embodiment.

As illustrated in the present embodiment and in other embodiments described later, the lever L that fixes and releases the fabric guide body C to and from the guide pin 5 is preferably provided in the present disclosure.

The lever L is formed of synthetic resin, a front half portion of which is an engage portion 22 that has a width allowing engagement with a recess between the protruding portions 14 and 15 of the fabric guide body C and a rear portion of which is a grip portion 23 that has the same width as the fabric guide body C.

Furthermore, a pivot hole 24 is drilled in the lateral side of the engage portion 22 so that the pivot pin 21 is inserted into the pivot hole 24.

A hook 25 that has an inner peripheral surface 25*a* having a dimension that coheres with the guide pin 5 is formed at the tip portion of the engage portion 22 to hold the guide pin 5.

Use modes and effects of the present embodiment will be described next.

In order to mount the presser device A with a fabric guide according to the present embodiment on a sewing machine, first, while the sewing needle is lifted, a presser holder (not shown) together with the presser bar is lifted and the presser device A is placed on a needle plate 40.

Subsequently, positioning of a transverse groove formed on an underside of the presser holder and the rod pin 3 of the presser foot B is carried out and, then, the presser holder is lowered so that the presser foot B is mounted on the transverse groove of the presser holder through the rod pin 3.

When edge stitching is carried out, a predetermined seam allowance needs to be set by adjusting the position of the fabric guide body C attached in a slidable manner to the presser foot B of the presser device A such that the guide portion 31 of the guide pin pressing plate D abuts against the edge of the fabric.

In order for the above, the presser bar is lifted and the presser device A is lifted away from the needle plate 40. Accordingly, a base 31*a* of the guide portion 31 of the guide pin pressing plate D is separated from an upper surface of the needle plate 40.

Figure 5A:
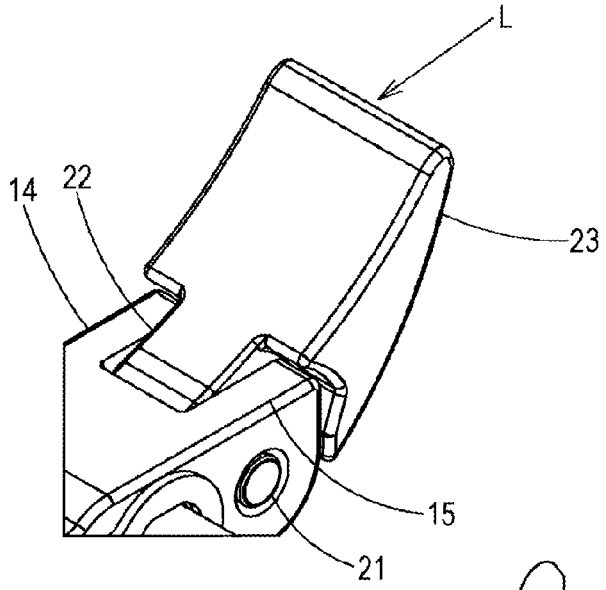
Figure 5B:
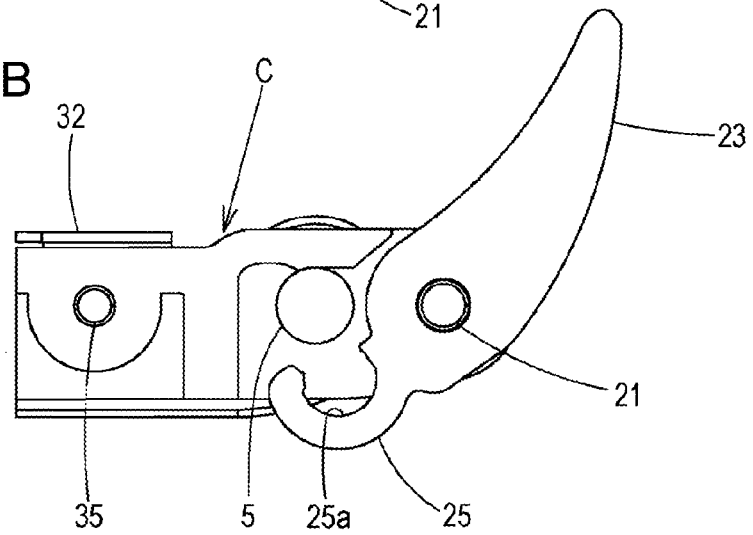
Figure 5C:
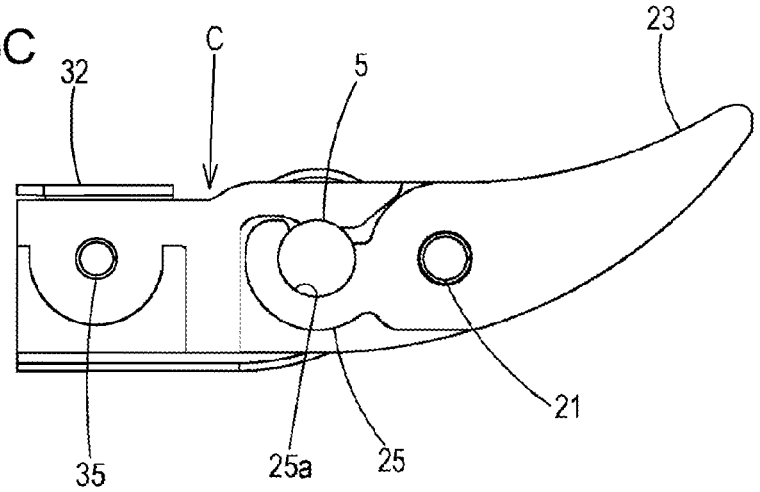

Then, when the grip portion 23 of the lever L that is pivotally supported in a swingable manner with the protruding portions 14 and 15 of the rear end portion of the fabric guide body C is lifted upwards, as illustrated in FIGS. 5A to 5C, the lever L is swung anticlockwise about the pivot pin 21 such that the inner peripheral surface 25*a* of the hook 25 that had been holding the guide pin 5 in a manner illustrated in FIG. 5C until then it is detached from the guide pin 5 as illustrated in FIG. 5B such that the fabric guide body C is in a released state that allows the fabric guide body C to freely slide along the guide pin 5 and the gauge 6.

Subsequently, the marks 13*a* that are provided on the edge of the window 13 formed on the upper surface of the fabric guide body C is adjusted to a measurement on one of the scales 6*a* of the gauge 6. As described above, since the values on the scales 6*a* each indicate a distance from the needle position mark M, the needle position mark M indicating the needle location when performing a straight stitch, to the left lateral side of the guide portion 31 of the guide pin pressing plate D, the fabric guide body C can be adjusted easily to a position having a desired seam allowance. Furthermore, in the above case, the visibility of the scales is satisfactory.

Note that as described above, since the gauge 6 is provided with two types of scales 6*a*, namely, a scale in millimeters and a scale in inches, it is possible to correspond to destinations where different scale units are used.

After the adjustment of the seam allowance is finished, when the grip portion 23 of the lever L is pushed down to its original state, the lever L is swung clockwise about the pivot pin 21; accordingly, the inner peripheral surface 25*a* of the hook 25 that had been detached from the guide pin 5 as illustrated in FIG. 5B until then holds the guide pin 5 once again as illustrated in FIG. 5C such that the fabric guide body C is in a securely fixed state.

Additionally, since the inner peripheral surface 25*a* of the hook 25 is, as described above, configured with a dimension that coheres with the guide pin 5, a click feel can be obtained in a reliable manner when the hook 25 is engaged with the guide pin 5.

Figure 4:
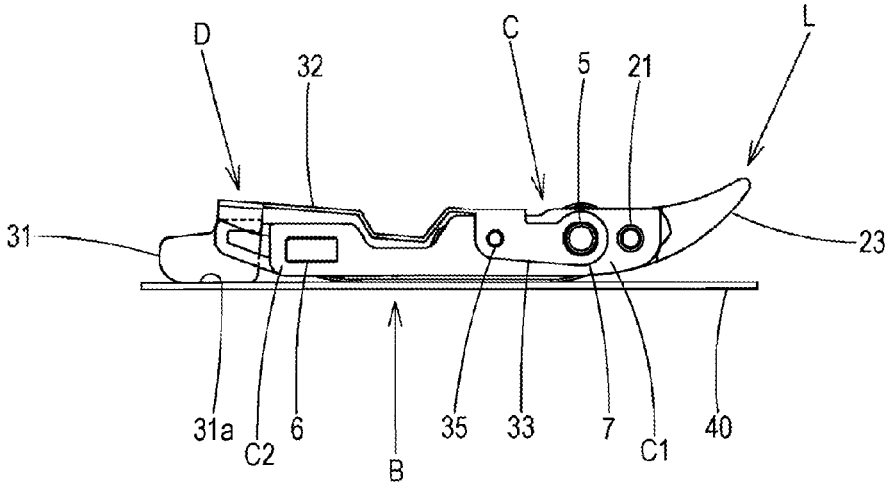
FIG. 4 is a right side view illustrating a state in which a stopper ring is removed from a guide pin after the presser device with a fabric guide according to the first embodiment is placed on the needle plate.

Furthermore, as illustrated in FIG. 2B, since the position of the base 31*a* of the guide portion 31 of the guide pin pressing plate D is configured below a bottom surface of the presser foot B, at the time of sewing, when the presser device A is lowered onto the needle plate 40, the base 31*a* of the guide portion 31 abuts against the upper surface of the needle plate 40 as illustrated in FIG. 4 and, accordingly, the top surface portion 32 of the guide pin pressing plate D is bent upwards.

As described above, the top surface portion 32 of the guide pin pressing plate D being bent upwards exerts a pivoting force to the guide pin pressing plate D in the clockwise direction, when viewed from the right lateral side of the fabric guide body C, about the spring pin 35 serving as a pivoting point such that flat portions 36*a* of the pressing holes 36 that are provided in the pair of holding portions 33 apply a downward pressing force to an outer peripheral surface of the guide pin 5; accordingly, force maintaining the position of the fabric guide body C with respect to the guide pin 5 is enhanced and rattling of the fabric guide body C can be prevented.

Furthermore, since the flat portion 36*a* is formed in the portion of each of the pressing holes 36 that abuts against the outer peripheral surface of the guide pin 5 (that applies pressing force to the guide pin 5), even if the abutting positions between the guide pin 5 and the pressing holes 36 are out of position due to aged deterioration and the like, since the outer peripheral surface of the guide pin 5 and each of the flat portions 36*a* of the pressing holes 36 abut against one another at a single point, there is no change in the pressing force applied to the guide pin 5 and a stable position maintaining state can be maintained.

As described above, in the present embodiment, a function of fixing or releasing the fabric guide body C to or from the guide pin 5 is added by the operation of the lever L; however, a feature of the present disclosure including the present embodiment and other embodiments described later is that with the work of the pressing holes 36 of the guide pin pressing plate D interlocking with the lowering movement of the presser device A, the position of the fabric guide body C can be firmly maintained with respect to the guide pin 5 without providing the lever L.

When the lever L is not provided, the diameter of the guide hole 11 of the fabric guide body C needs to be set slightly tighter than that described in the present embodiment with respect to the diameter of the guide pin 5.

Then, similar to the present embodiment, at the time of sewing after sliding and adjusting the fabric guide body C in the transverse direction so as to obtain the desired seam allowance, when the presser device A is lowered onto the needle plate 40, the top surface portion 32 of the guide pin pressing plate D is bent upwards such that a pivoting force acts on the guide pin pressing plate D about the spring pin 35 in the clockwise direction when viewed from the right lateral side of the fabric guide body C and, accordingly, a downward pressing force is applied with the flat portions 36*a* of the pressing holes 36 to the guide pin 5 such that the position of the fabric guide body C can be maintained in a firm manner with respect to the guide pin 5.

Second Embodiment

A second embodiment added with a guide plate that is separate from the guide pin pressing plate of the first embodiment will be described next.

In the present embodiment, components that are the same as the first embodiment will be designated with the same reference numerals and will be illustrated in the drawings while description thereof are omitted, and points that are different will be mainly described.

Figure 6:
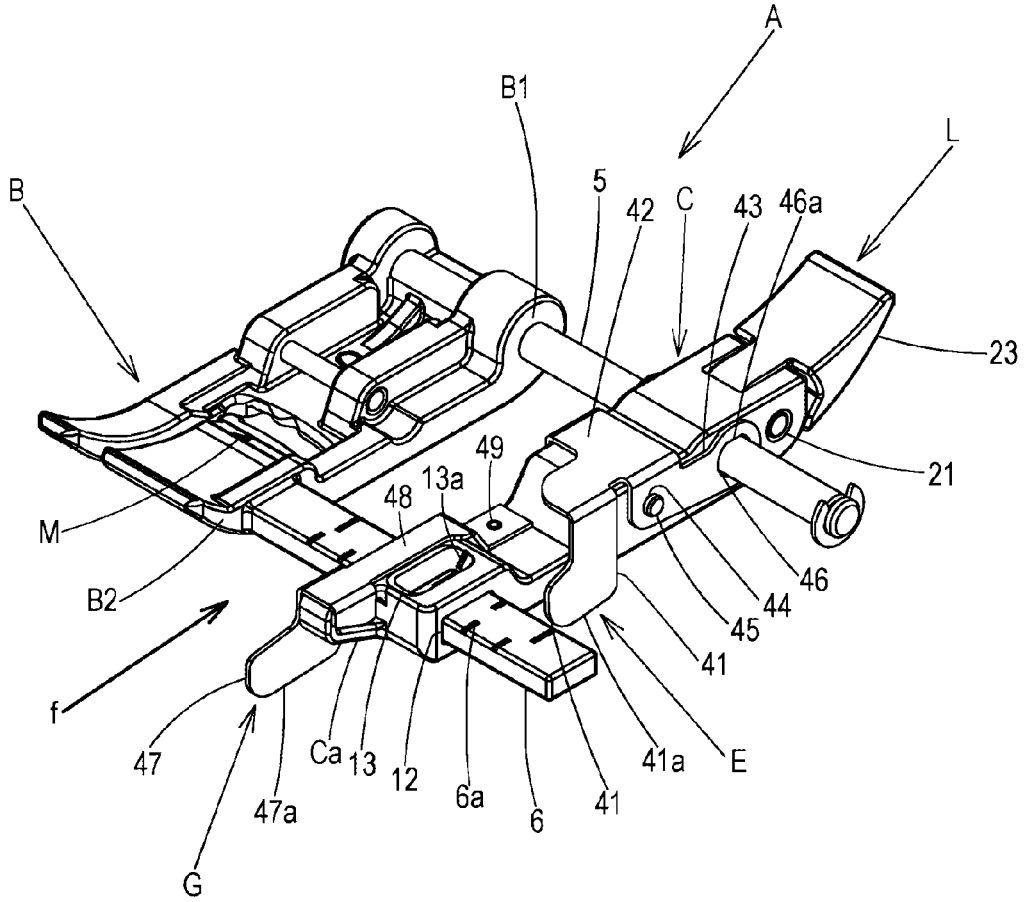
FIG. 6 is a perspective view illustrating the entire presser device with a fabric guide according to a second embodiment of the present disclosure.

Referring to FIG. 6, reference character A represents the presser device with a fabric guide. The presser device A includes the presser foot B, the fabric guide body C that is provided in a parallel manner to the presser foot B, the position of the fabric guide body C being slidably adjustable, a guide pin pressing plate E that is pivotally fitted to the rear portion of the fabric guide body C, and a guide plate G that is attached to the front portion of the fabric guide body C.

The cylindrical metal guide pin 5 extending from the rear lateral side portion B1 in the transverse direction is provided in the presser foot B, and the rectangular parallelepiped-shaped gauge 6 that is integrally formed with the presser foot B and that extends from the front lateral side portion B2 in a parallel manner to the guide pin 5 is provided.

Scales 6*a* that indicate the distance from the needle position mark M to a left lateral side of a guide portion 47 described later are provided on the upper surface of the gauge 6.

The window 13 for sighting the scales 6*a* of the gauge 6 is formed on the front upper side of the fabric guide body C so as to reach the gauge insertion hole 12.

The guide pin pressing plate E is formed of a plate-shaped flexible material that extends along the upper surface of the fabric guide body C and includes a pushing-portion 41 that is a right side of the guide pin pressing plate E perpendicularly bent from the upper surface of the fabric guide body C between the gauge insertion hole 12 and the pin hole 17 (see FIG. 3), a top surface portion 42 that covers the upper surface of the fabric guide body C above the pin hole 17, and a pair of holding portions 43 that hold therebetween the lateral sides of the fabric guide body C from the pin hole 17 towards the rear portion.

Fulcrum holes 44 are formed at a front of the holding portions 43. By inserting a spring pin 45 into the fulcrum holes 44 through the pin hole 17 in the lateral side of the fabric guide body C, the guide pin pressing plate E is pivotally fitted along the lateral sides of the fabric guide body C.

Furthermore, pressing holes 46 into which the guide pin 5 is inserted and that each have a diameter that is slightly larger than that of the guide pin 5 are provided at rear ends of the holding portions 43.

Flat portions 46*a* are formed at upper portions of the pressing holes 46, in which the upper portions correspond to the sides that apply pressing force to the guide pin 5.

The guide plate G is formed of a plate-shaped flexible material that extends along the upper surface of the fabric guide body C and that is bent perpendicularly so as to hold the two sides of the tip portion Ca of the fabric guide body C from above. The guide plate G includes a guide portion 47 that is a perpendicularly bent portion on the left side of the perpendicularly bent portions when viewed from the front and that protrudes out to the front of the fabric guide body C, a top surface portion 48 that covers the front upper surface of the fabric guide body C, and a fixing portion 49 that attaches a rear end portion of the top surface portion 48 to the upper surface of the fabric guide body C.

Note that the fixing portion 49 may be any one of a variety of fixing members, such as a rivet, selected as required.

Use modes and effects of the present embodiment will be described next.

The presser device A with a fabric guide according to the present embodiment is mounted on the sewing machine in a similar manner to that of the first embodiment.

The fabric guide body C is supported in a stable manner by the guide pin 5 and the gauge 6 that are formed in the transverse direction from the rear lateral side portion B1 and the front lateral side portion B2, respectively, of the presser foot B such that the fabric guide body C is allowed to slide only in the transverse direction.

When the grip portion 23 of the lever L of the fabric guide body C is lifted upwards, the lever L is swung anticlockwise about the pivot pin 21 such that, similar to the first embodiment, the fabric guide body C is in a released state that allows the fabric guide body C to freely slide along the guide pin 5 and the gauge 6.

Subsequently, the marks 13*a* that are provided on the edge of the window 13 formed on the upper surface of the fabric guide body C is adjusted to a measurement on one of the scales 6*a* of the gauge 6. Similar to the first embodiment, since the values on the scales 6*a* each indicate a distance from the needle position mark M, the needle position mark M indicating the needle location when performing a straight stitch, to the left lateral side of the guide portion 47 of the guide plate G, adjustment to a desired seam allowance can be performed easily.

In the present embodiment, a guide plate G separate from the guide pin pressing plate E is attached to the fabric guide body C; accordingly, the position of an abutting side 41*a* of a pushing-up portion 41 of the guide pin pressing plate E is configured below the bottom surface of the fabric guide body C (the presser foot B).

Accordingly, at the time of sewing, when the presser device A is lowered onto the needle plate 40, the abutting side 41*a* of the pushing-up portion 41 abuts against the upper surface of the needle plate 40 such that the pushing-up portion 41 of the guide pin pressing plate E is pushed up.

As described above, the pushing-up portion 41 of the guide pin pressing plate E being pushed up exerts a pivoting force to the guide pin pressing plate E in the clockwise direction, when viewed from the right lateral side of the fabric guide body C, about the spring pin 45 serving as a pivoting point such that flat portions 46*a* of the pressing holes 46 that are provided in the pair of holding portions 43 apply a downward pressing force to the guide pin 5; accordingly, force maintaining the position of the guide pin 5 with respect to the fabric guide body C is enhanced and rattling of the fabric guide body C can be prevented.

Other effects are similar to those of the first embodiment.

Third Embodiment

A third embodiment that is an embodiment in which the configuration of the guide pin pressing plate has been changed with respect to that of the second embodiment will be described next.

In the present embodiment, components that are the same as the first and second embodiments will be designated with the same reference numerals and will be illustrated in the drawings while description thereof are omitted, and points that are different will be mainly described.

Figure 7A:
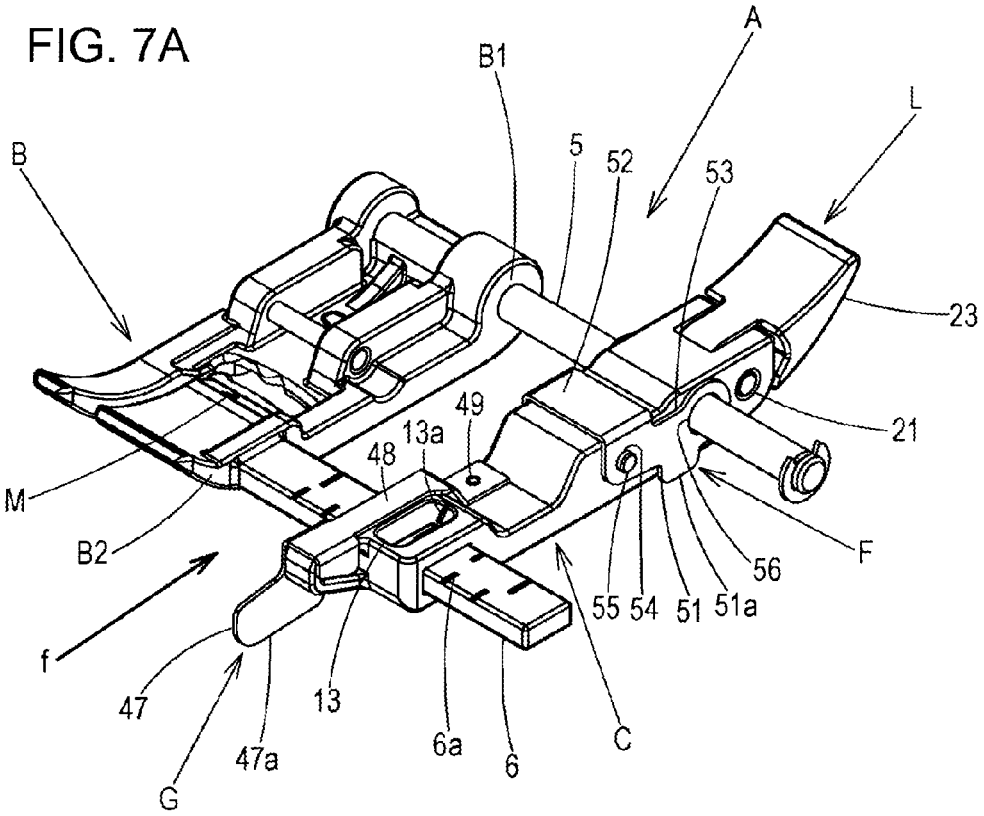

Referring to FIG. 7A, reference character A represents the presser device with a fabric guide. The presser device A includes the presser foot B, the fabric guide body C that is provided in a parallel manner to the presser foot B, the position of the fabric guide body C being slidably adjustable, a guide pin pressing plate F that is pivotally fitted to the rear portion of the fabric guide body C, and a guide plate G that is attached to the front portion of the fabric guide body C.

The guide pin pressing plate F is formed of a plate-shaped flexible material that extends along the upper surface of the fabric guide body C and includes a top surface portion 52 that covers the upper surface of the fabric guide body C above the pin hole 17 (see FIG. 3), a pair of holding portions 53 that hold therebetween the lateral sides of the fabric guide body C from the pin hole 17 towards the rear portion, and a pushing-up portion 51 in which, when seen from the front of the holding portions 53, only the right side protrudes downwards at the portion between the pin hole 17 and the guide hole 11 of the fabric guide body C.

Fulcrum holes 54 are formed at the front of the holding portions 53. By inserting a spring pin 55 into the fulcrum holes 54 through the pin hole 17 in the lateral side of the fabric guide body C, the guide pin pressing plate F is pivotally fitted along the lateral sides of the fabric guide body C.

Furthermore, pressing holes 56 into which the guide pin 5 is inserted and that each have a diameter that is slightly larger than that of the guide pin 5 are provided at rear ends of the holding portions 53.

Flat portions 56*a* are formed at the lower portions of the pressing holes 56, in which the lower portions correspond to the sides that apply pressing force to the guide pin 5.

Use modes and effects of the present embodiment will be described next.

The presser device A with a fabric guide according to the present embodiment is mounted on the sewing machine in a similar manner to that of the first embodiment.

The fabric guide body C is supported in a stable manner by the guide pin 5 and the gauge 6 that are formed in the transverse direction from the rear lateral side portion B1 and the front lateral side portion B2, respectively, of the presser foot B such that the fabric guide body C is allowed to slide only in the transverse direction.

Figure 7B:
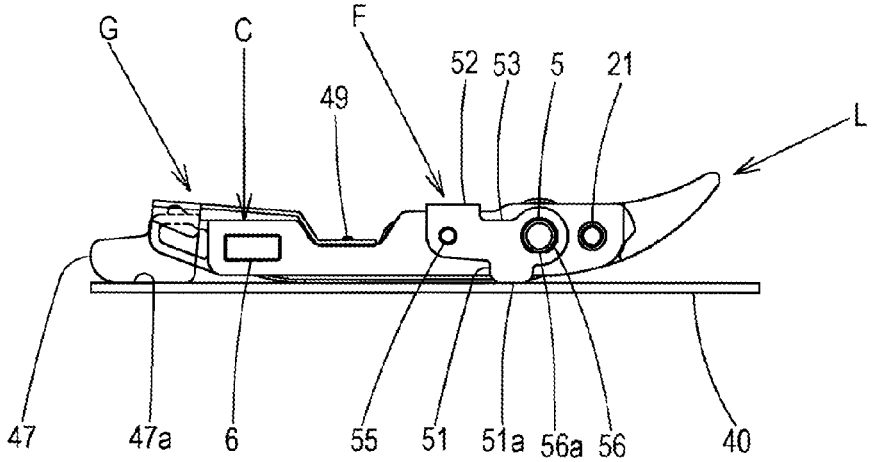

As illustrated in FIG. 7B, since the position of a base 47*a* of the guide portion 47 of the guide plate G is configured below the bottom surface of the presser foot B, at the time of sewing, when the base 47*a* of the guide portion 47 abuts against the upper surface of the needle plate 40, the top surface portion 48 of the guide plate G is bent upwards having the fixing portion 49 as its fulcrum; accordingly, even if the presser foot B moves up and down, the guide portion 47 can follow the upper surface of the needle plate 40 at all times.

Furthermore, in the present embodiment, similar to the second embodiment, the position of an abutting side 51*a* of the pushing-up portion 51 of the guide pin pressing plate F is configured below the bottom surface of the fabric guide body C (the presser foot B).

Accordingly, at the time of sewing, when the presser device A is lowered onto the needle plate 40, the abutting side 51*a* of the pushing-up portion 51 abuts against the upper surface of the needle plate 40 such that the pushing-up portion 51 of the guide pin pressing plate F is lifted up.

As described above, the pushing-up portion 51 of the guide pin pressing plate F being pushed up exerts a pivoting force to the guide pin pressing plate F in the anticlockwise direction, when viewed from the right lateral side of the fabric guide body C, about the spring pin 55 serving as a pivoting point such that flat portions 56*a* of the pressing holes 56 that are provided in the pair of holding portions 53 apply an upward pressing force to the guide pin 5; accordingly, force maintaining the position of the guide pin 5 with respect to the fabric guide body C is enhanced and rattling of the fabric guide body C can be prevented.

Other effects are similar to those of the second embodiment.

In the presser device with a fabric guide according to the present disclosure, edge stitching is carried out by sliding and adjusting a fabric guide body that is provided parallel to a presser foot. Different from conventional presser devices, when adjusting the seam allowance, the fixed fabric guide body can be released easily, and can be firmly fixed after carrying out sliding and adjusting thereof; accordingly, repetition of edge stitching with the desired seam allowance can be carried out in a reliable manner, and the presser device can be widely applied to various sewing machines with advantage.

What is claimed is:

1. A presser device with a fabric guide, comprising:

a presser foot that is mounted on the presser bar of a sewing machine;

a fabric guide body that is provided parallel to the presser foot, a position of the fabric guide body being slidable and adjustable;

a guide pin that is provided from a lateral portion of the presser foot in a direction orthogonal to a fabric feeding direction;

the fabric guide body guiding an edge of a fabric, the guide pin being inserted through a guide hole of the fabric guide body;

a guide pin pressing plate that is pivotally fitted to the fabric guide body, wherein the guide pin pressing plate having a pushing-up portion that abuts against a needle plate and that exerts a pivoting force about a pivoting point, and a pressing hole through which the guide pin is inserted, the pressing hole applying pressing force to the guide pin, wherein the guide pin pressing plate is formed of a plate-shaped flexible material that extends along an upper surface of the fabric guide body and includes the pushing-up portion that protrudes below a bottom surface of the presser foot, a top surface portion that covers an upper surface of the fabric guide body, and a pair of holding portions that hold rear lateral sides of the fabric guide body therebetween and that are each provided with the pressing hole at a rear end of the fabric guide body.

2. The presser device with a fabric guide according to claim 1, wherein the pushing-up portion of the guide pin pressing plate further serves as a guide portion that guides the edge of a fabric.

3. The presser device with a fabric guide according to claim 2, wherein the pressing hole of the guide pin pressing plate includes a flat portion formed on a side that applies pressing force to the guide pin.

4. The presser device with a fabric guide according to claim 1, wherein the pressing hole of the guide pin pressing plate includes a flat portion formed on a side that applies pressing force to the guide pin.

5. A presser device with a fabric guide, comprising:

a presser foot that is mounted on the presser bar of a sewing machine;

a fabric guide body that is provided parallel to the presser foot, a position of the fabric guide body being slidable and adjustable;

a guide pin that is provided from a lateral portion of the presser foot in a direction orthogonal to a fabric feeding direction;

the fabric guide body guiding an edge of a fabric, the guide pin being inserted through a guide hole of the fabric guide body;

a guide pin pressing plate that is pivotally fitted to the fabric guide body, wherein the guide pin pressing plate having a pushing-up portion that abuts against a needle plate and that exerts a pivoting force about a pivoting point, and a pressing hole through which the guide pin is inserted, the pressing hole applying pressing force to the guide pin, further comprising a lever that is pivotally fitted to the fabric guide body, the lever fixing and releasing the fabric guide body to and from the guide pin by being swung to a position in which a tip of a hook holds the guide pin and to a position in which the tip of the hook is released from the guide pin.

6. The presser device with a fabric guide according to claim 5, wherein the pushing-up portion of the guide pin pressing plate further serves as a guide portion that guides the edge of a fabric.

7. The presser device with a fabric guide according to claim 6, wherein the pressing hole of the guide pin pressing plate includes a flat portion formed on a side that applies pressing force to the guide pin.

8. The presser device with a fabric guide according to claim 7, wherein the guide pin pressing plate is formed of a plate-shaped flexible material that extends along an upper surface of the fabric guide body and includes the pushing-up portion that protrudes below a bottom surface of the presser foot, a top surface portion that covers an upper surface of the fabric guide body, and a pair of holding portions that hold rear lateral sides of the fabric guide body therebetween and that are each provided with the pressing hole at a rear end of the fabric guide body.

9. The presser device with a fabric guide according to claim 6, wherein the guide pin pressing plate is formed of a plate-shaped flexible material that extends along an upper surface of the fabric guide body and includes the pushing-up portion that protrudes below a bottom surface of the presser foot, a top surface portion that covers an upper surface of the fabric guide body, and a pair of holding portions that hold rear lateral sides of the fabric guide body therebetween and that are each provided with the pressing hole at a rear end of the fabric guide body.

10. The presser device with a fabric guide according to claim 5, wherein the pressing hole of the guide pin pressing plate includes a flat portion formed on a side that applies pressing force to the guide pin.

11. The presser device with a fabric guide according to claim 10, wherein the guide pin pressing plate is formed of a plate-shaped flexible material that extends along an upper surface of the fabric guide body and includes the pushing-up portion that protrudes below a bottom surface of the presser foot, a top surface portion that covers an upper surface of the fabric guide body, and a pair of holding portions that hold rear lateral sides of the fabric guide body therebetween and that are each provided with the pressing hole at a rear end of the fabric guide body.

12. The presser device with a fabric guide according to claim 5, wherein the guide pin pressing plate is formed of a plate-shaped flexible material that extends along an upper surface of the fabric guide body and includes the pushing-up portion that protrudes below a bottom surface of the presser foot, a top surface portion that covers an upper surface of the fabric guide body, and a pair of holding portions that hold rear lateral sides of the fabric guide body therebetween and that are each provided with the pressing hole at a rear end of the fabric guide body.

13. A presser device with a fabric guide, comprising:

a presser foot that is mounted on the presser bar of a sewing machine;

a fabric guide body that is provided parallel to the presser foot, a position of the fabric guide body being slidable and adjustable;

a guide pin that is provided from a lateral portion of the presser foot in a direction orthogonal to a fabric feeding direction;

the fabric guide body guiding an edge of a fabric, the guide pin being inserted through a guide hole of the fabric guide body;

a guide pin pressing plate that is pivotally fitted to the fabric guide body, wherein the guide pin pressing plate having a pushing-up portion that abuts against a needle plate and that exerts a pivoting force about a pivoting point, and a pressing hole through which the guide pin is inserted, the pressing hole applying pressing force to the guide pin, wherein the presser foot includes a gauge that is provided parallel to the guide pin from the front lateral side of the presser foot, the gauge being provided with a scale, and the fabric guide body includes an insertion hole into which the gauge is inserted.

14. The presser device with a fabric guide according to claim 13, wherein the pushing-up portion of the guide pin pressing plate further serves as a guide portion that guides the edge of a fabric.

15. The presser device with a fabric guide according to claim 14, wherein the pressing hole of the guide pin pressing plate includes a flat portion formed on a side that applies pressing force to the guide pin.

16. The presser device with a fabric guide according to claim 15, wherein the guide pin pressing plate is formed of a plate-shaped flexible material that extends along an upper surface of the fabric guide body and includes the pushing-up portion that protrudes below a bottom surface of the presser foot, a top surface portion that covers an upper surface of the fabric guide body, and a pair of holding portions that hold rear lateral sides of the fabric guide body therebetween and that are each provided with the pressing hole at a rear end of the fabric guide body.

17. The presser device with a fabric guide according to claim 16, wherein a lever that is pivotally fitted to the fabric guide body, the lever fixing and releasing the fabric guide body to and from the guide pin by being swung to a position in which a tip of a hook holds the guide pin and to a position in which the tip of the hook is released from the guide pin.

18. The presser device with a fabric guide according to claim 15, wherein a lever that is pivotally fitted to the fabric guide body, the lever fixing and releasing the fabric guide body to and from the guide pin by being swung to a position in which a tip of a hook holds the guide pin and to a position in which the tip of the hook is released from the guide pin.

19. The presser device with a fabric guide according to claim 14, wherein the guide pin pressing plate is formed of a plate-shaped flexible material that extends along an upper surface of the fabric guide body and includes the pushing-up portion that protrudes below a bottom surface of the presser foot, a top surface portion that covers an upper surface of the fabric guide body, and a pair of holding portions that hold rear lateral sides of the fabric guide body therebetween and that are each provided with the pressing hole at a rear end of the fabric guide body.

20. The presser device with a fabric guide according to claim 19, wherein a lever that is pivotally fitted to the fabric guide body, the lever fixing and releasing the fabric guide body to and from the guide pin by being swung to a position in which a tip of a hook holds the guide pin and to a position in which the tip of the hook is released from the guide pin.

21. The presser device with a fabric guide according to claim 14, wherein a lever that is pivotally fitted to the fabric guide body, the lever fixing and releasing the fabric guide body to and from the guide pin by being swung to a position in which a tip of a hook holds the guide pin and to a position in which the tip of the hook is released from the guide pin.

22. The presser device with a fabric guide according to claim 13, wherein the pressing hole of the guide pin pressing plate includes a flat portion formed on a side that applies pressing force to the guide pin.

23. The presser device with a fabric guide according to claim 22, wherein the guide pin pressing plate is formed of a plate-shaped flexible material that extends along an upper surface of the fabric guide body and includes the pushing-up portion that protrudes below a bottom surface of the presser foot, a top surface portion that covers an upper surface of the fabric guide body, and a pair of holding portions that hold rear lateral sides of the fabric guide body therebetween and that are each provided with the pressing hole at a rear end of the fabric guide body.

24. The presser device with a fabric guide according to claim 23, wherein a lever that is pivotally fitted to the fabric guide body, the lever fixing and releasing the fabric guide body to and from the guide pin by being swung to a position in which a tip of a hook holds the guide pin and to a position in which the tip of the hook is released from the guide pin.

25. The presser device with a fabric guide according to claim 22, wherein a lever that is pivotally fitted to the fabric guide body, the lever fixing and releasing the fabric guide body to and from the guide pin by being swung to a position in which a tip of a hook holds the guide pin and to a position in which the tip of the hook is released from the guide pin.

26. The presser device with a fabric guide according to claim 13, wherein the guide pin pressing plate is formed of a plate-shaped flexible material that extends along an upper surface of the fabric guide body and includes the pushing-up portion that protrudes below a bottom surface of the presser foot, a top surface portion that covers an upper surface of the fabric guide body, and a pair of holding portions that hold rear lateral sides of the fabric guide body therebetween and that are each provided with the pressing hole at a rear end of the fabric guide body.

27. The presser device with a fabric guide according to claim 26, wherein a lever that is pivotally fitted to the fabric guide body, the lever fixing and releasing the fabric guide body to and from the guide pin by being swung to a position in which a tip of a hook holds the guide pin and to a position in which the tip of the hook is released from the guide pin.

28. The presser device with a fabric guide according to claim 13, wherein a lever that is pivotally fitted to the fabric guide body, the lever fixing and releasing the fabric guide body to and from the guide pin by being swung to a position in which a tip of a hook holds the guide pin and to a position in which the tip of the hook is released from the guide pin.

* * * * *